United States Patent [19]

Shank et al.

[11] Patent Number: 4,480,412

[45] Date of Patent: Nov. 6, 1984

[54] IN-PROCESS GRINDING GAGE

[75] Inventors: William E. Shank; Kenneth K. Bercaw, both of Waynesboro, Pa.

[73] Assignee: Litton Industrial Products, Inc., Waynesboro, Pa.

[21] Appl. No.: 414,845

[22] Filed: Sep. 3, 1982

[51] Int. Cl.[3] ..... B24B 49/04

[52] U.S. Cl. ..... 51/165 R; 33/178 E; 33/147 L; 33/148 H; 51/105 R

[58] Field of Search ..... 51/105 R, 105 SP, 165 R, 51/165.91, 165.83; 33/178 E, 178 D, 147 L, 148 H, 148 F

[56] References Cited

U.S. PATENT DOCUMENTS

| | | | |
|---|---|---|---|
| 1,911,890 | 5/1933 | Fraser | 51/165.91 |
| 2,267,391 | 12/1941 | Astrowski | 51/165.91 |
| 3,031,805 | 5/1962 | Snyder | 51/165 R |
| 3,427,755 | 2/1969 | Levesque | 51/165 R |

*Primary Examiner*—Harold D. Whitehead
*Attorney, Agent, or Firm*—Spencer T. Smith

[57] ABSTRACT

An in-process grinding gage providing a means for continuously indicating the diameter of a cylindrical workpiece being ground comprising a mounting bracket gaging head means including a body including fixed upper and center pads and an arm pivotally secured to the body and including a lower pad, arm spring means for urging the lower pad into engagement with the workpiece, leaf spring means secured to the mounting bracket and having a free end, the gaging head means secured to the leaf spring and positioned so that the upper and center pads engage the workpiece which is to be ground to size, the leaf spring and the arm spring comprising means for continuously maintaining all three pads in contact with the workpiece as it is ground to size.

3 Claims, 3 Drawing Figures

IN-PROCESS GRINDING GAGE

BACKGROUND AND OBJECTS OF THE INVENTION

In the centerless grinding process for precision parts, such as automotive cam and crank shafts, in-process gaging provides a means for continuously compenating for grinding wheel wear and loading. In-process gaging can also be used to control the grinding wheel feed rates and the grinding machine work cycle. When simultaneously grinding a plurality of axially spaced cylindrical surfaces on a workpiece, use of more than one in-process gage will indicate any taper across the length of the workpiece.

It is, therefore, an object of the invention to provide an in-process grinding gage.

It is also an object of the invention to provide a gage which self centers on a cylindrical workpiece.

It is a further object of the invention to provide a gage which can be remotely and automatically brought into engagement with and disengaged from a workpiece.

It is another object of the invention to provide a gage which generates an electrical signal which can be used to continuously vary the grinding wheel feed rate.

It is a further object of the invention to provide a gage whose electrical output can be used to control the grinding machine cycle.

It is yet another object of the invention to provide a gage which, when used in multiples, can indicate undesired taper over the length of a cylindrical workpiece.

DESCRIPTION OF THE PREFERRED EMBODIMENT

Figure 1:
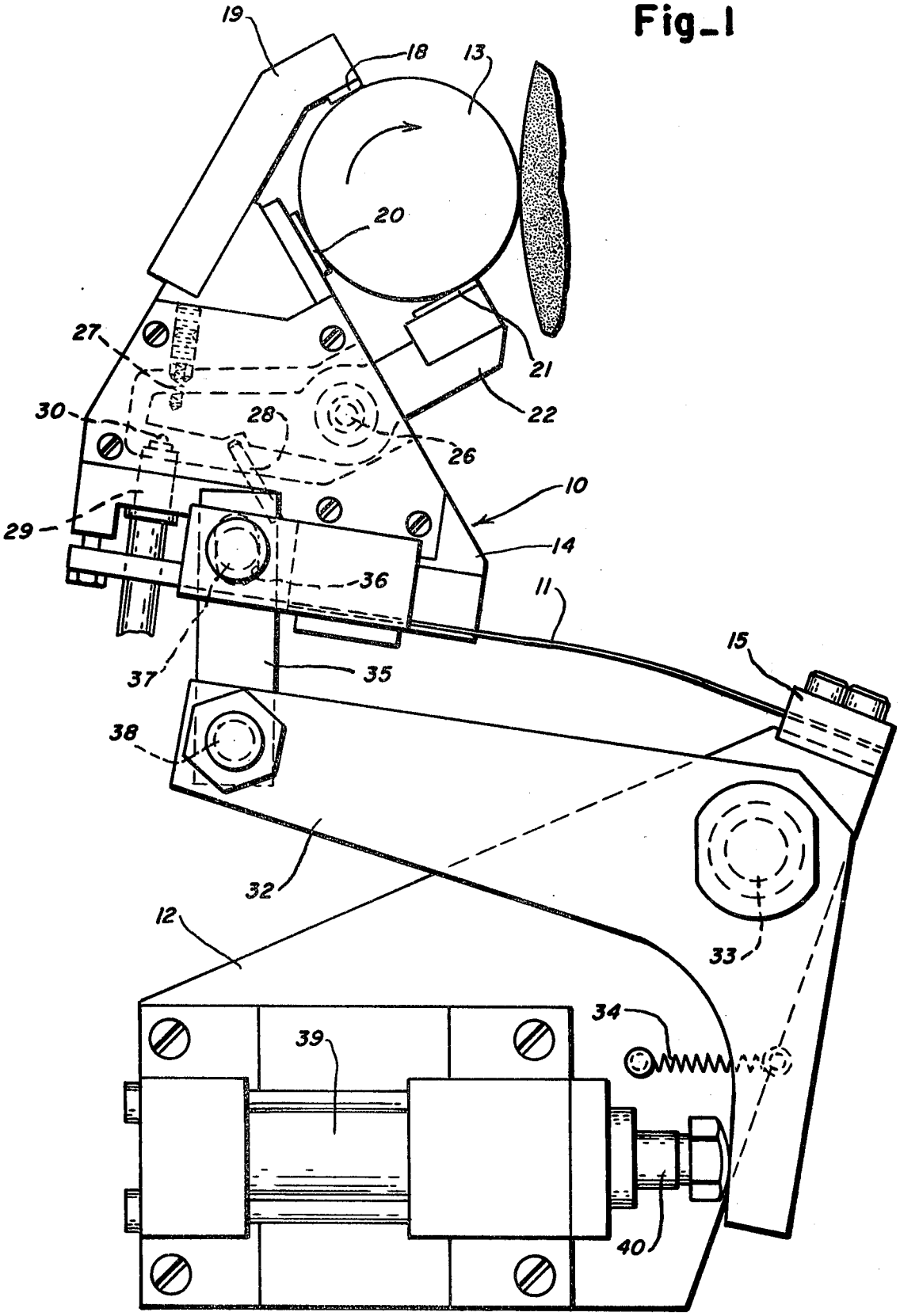
FIG. 1 is a side view of the in-process grinding gage engaging a workpiece before machining.

Referring to FIG. 1, the in-process grinding gage shown is comprised of a gaging head 10 fixedly secured to a leaf spring 11. The spring 11 is attached via a clamp 15 to the mounting bracket 12 which in turn is attached to the grinding machine (not shown).

The gaging head 10 engages the workpiece 13 at three points: upper pad 18 attached to the upper arm 19, the center pad 20, and lower pad 21 attached to the lower arm 22. The upper arm 19 and center pad 20 are rigidly mounted to the gage head body 14. The lower arm 22 is pivotally mounted to the gage head body 14 at pivot 26.

Figure 2:
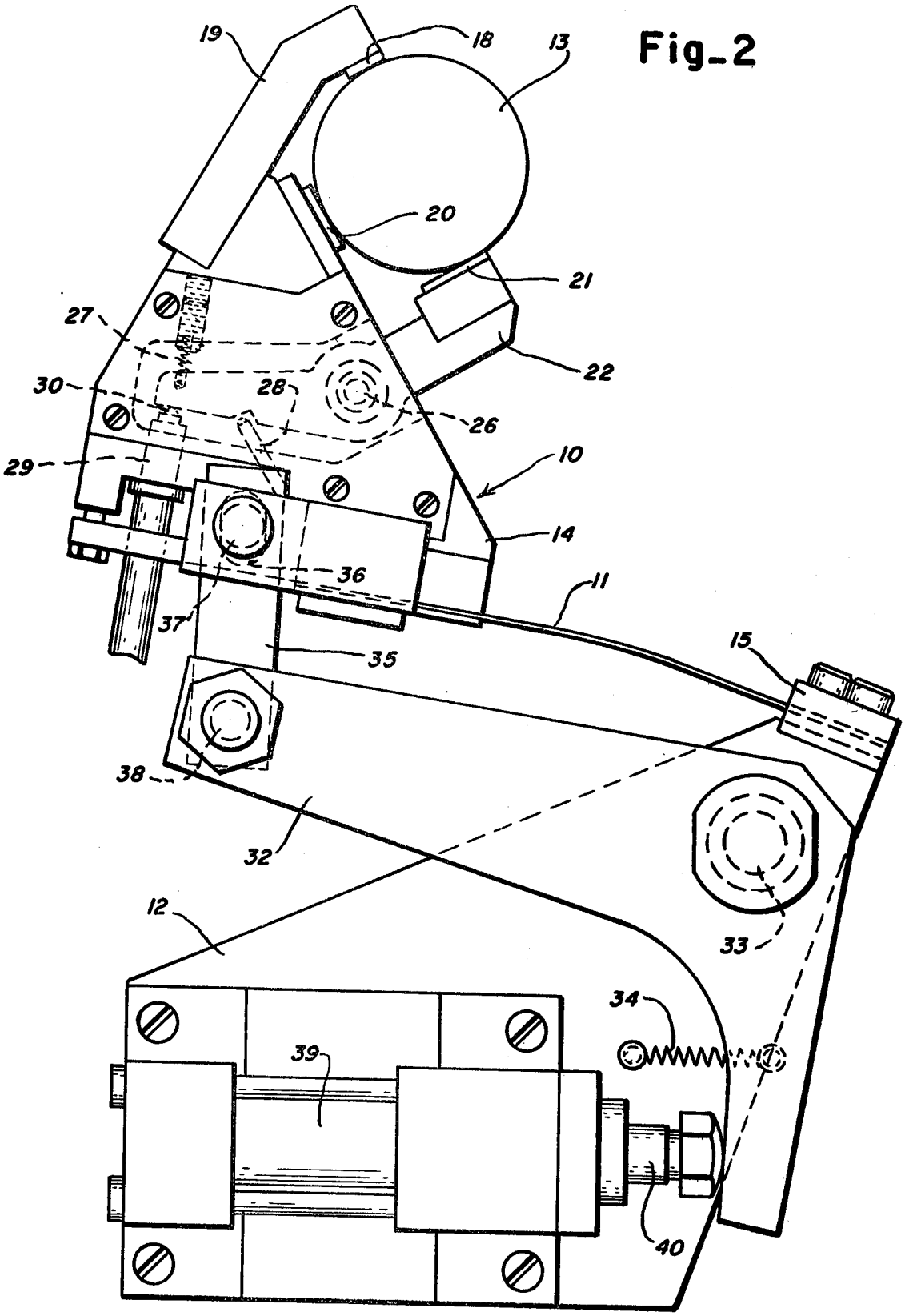
FIG. 2 is the same view as FIG. 1 after grinding the workpiece to a finished dimension.

Leaf spring 11 is deflected in a counterclockwise direction, maintaining pads 18 and 20 in forceful contact with workpiece 13 throughout the gaging cycle, and thereby establishing reference points for gaging the workpiece diameter. Compression spring 27, acting through lower arm 22 as it rotates about pivot 26, maintains lower pad 21 in forceful contact with workpiece 13 throughout the gaging cycle. As material is ground from the outer diameter of the workpiece 13, pad 21, moving radially in toward the center of the workpiece, causes arm 22 to displace plunger 30 of transducer 29 as best seen in FIG. 2 thereby generating an electrical signal which is an analog of the diameter of the workpiece. This signal through associated controls (not shown) reduces the grinding wheel in-feed rate as the workpiece approaches a pre-set diameter and causes the machine to stop and the gage to retract when the finished diameter is achieved.

Engagement of the gaging head with workpiece 13 is initiated as the hydraulic arm 40 retracts. Operator arm 32 rotates, motivated by spring 34, allowing spring 11 to act on the gage head 10 bringing pads 18 and 20 into contact with workpiece 13 leaving the gage head free to follow the workpiece surface as it is ground and as pin 37 is free to move in slot 36. Lower arm 22 rotates around pivot 26 compressing spring 27 as pad 21 engages the workpiece. The combined spring forces of leaf spring 11 and compression spring 27 acting through pads 18, 20, and 21 effect a slight change or orientation of the gage body which as has already been noted is secured to a spring element which can be deflected or bowed to permit such reorientation. The gage head 10 is thereby continuously centered about the workpiece to maintain the three pads in continuous engagement with the decreasing outer diameter of the workpiece being ground and hence centrality is maintained throughout the grinding process.

Figure 3:
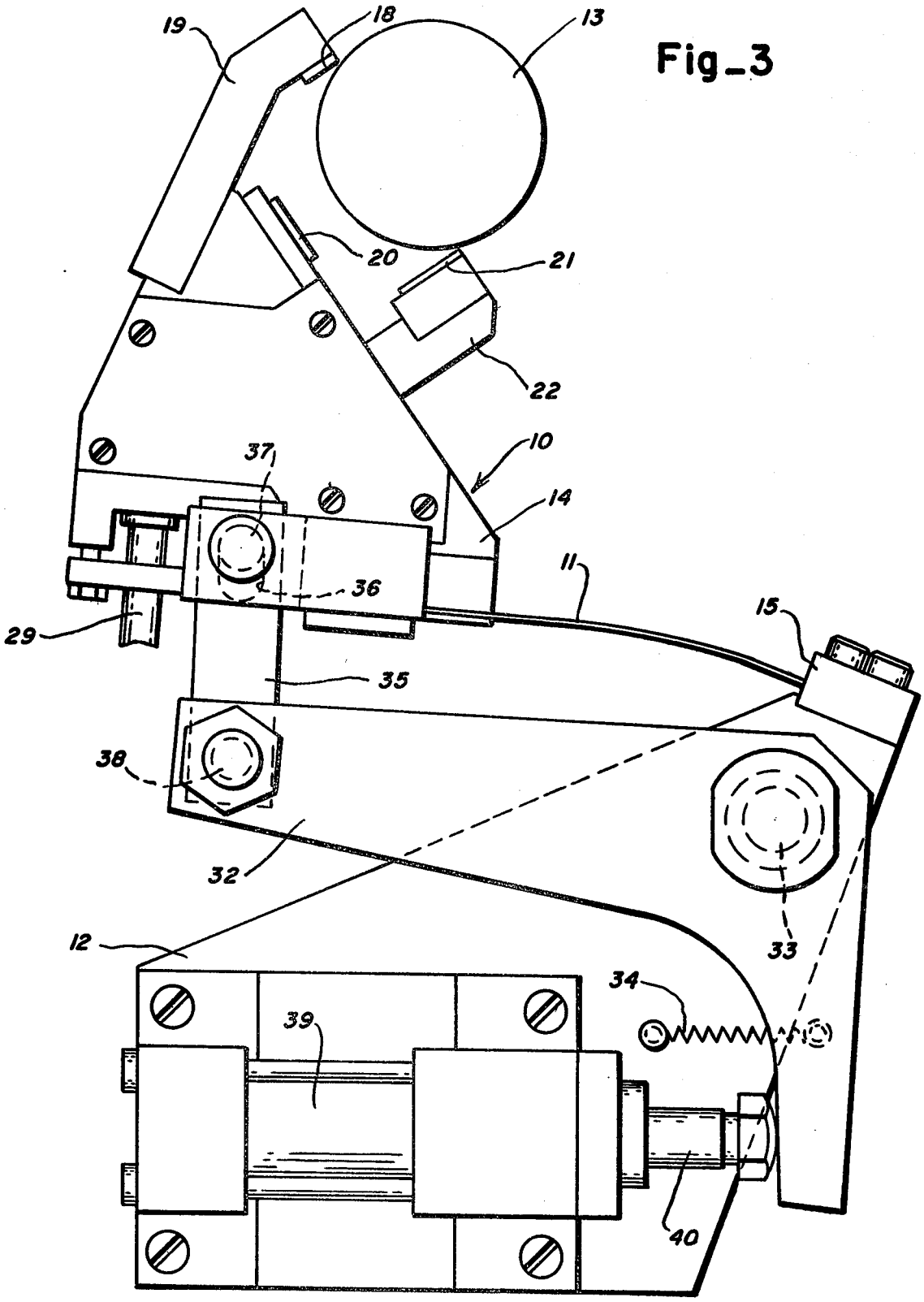
FIG. 3 is the same view as FIGS. 1 and 2 with the gage disengaged from the workpiece.

Retraction of gaging head 10 from the workpiece is accomplished by rotating operating arm 32 about pivot 33 through the action of hydraulic cylinder 39 extending arm 40 against the force of operator spring 34 as seen in FIG. 3. Link 35, pivotally attached to arm 32 at pivot 38 and engaging pin 37 through link slot 36, while effectively neutral in the gage on position causes gaging head 10 to move counterclockwise against the load of leaf spring 11 in an arcuate path defined by spring 11.

The limit stop 28 of the lower arm 22 limits the motion of arm 22 when the workpiece 13 is removed, thus preventing damage to transducer 29.

If cylindrical workpiece 13 has a plurality of diameters to be ground simultaneously along its axis, undesirable axial taper can be detected by employing more than one gage, preferably at either end of the workpiece, and monitoring to determine that all gages reach their preset diameter simultaneously.

What is claimed is:

1. An in-process grinding gage providing a means for continuously indicating the diameter of a cylindrical workpiece being ground comprising
   - gaging head means including
     - a body including fixed upper and center pads,
     - an arm pivotally secured to said body and including a lower pad,
     - arm spring means for urging said lower pad into engagement with the workpiece,
   - mounting bracket means,
   - leaf spring means secured at one end to said mounting bracket and having a free end,
   - said gaging head means secured to said free end of said leaf spring and positioned so that said upper and center pads engage the workpiece which is to be ground to size,
   - said leaf spring and said arm spring comprising means for continuously maintaining all three pads in contact with the workpiece as it is ground to size.

2. An in-process grinding gage according to claim 1 including a hydraulic cylinder means for disengaging said gaging head means.

3. An in-process grinding gage according to claim 2 including a linkage means which operatively disengages said gaging head means from said hydraulic means.

* * * * *